US007681665B2

(12) United States Patent
Eppink

(10) Patent No.: US 7,681,665 B2
(45) Date of Patent: Mar. 23, 2010

(54) DOWNHOLE HYDRAULIC CONTROL SYSTEM

(75) Inventor: Jay Milton Eppink, Spring, TX (US)

(73) Assignee: Smith International, Inc., Houston, TX (US)

( * ) Notice: Subject to any disclaimer, the term of this patent is extended or adjusted under 35 U.S.C. 154(b) by 123 days.

(21) Appl. No.: 12/074,442

(22) Filed: Mar. 4, 2008

(65) Prior Publication Data

US 2009/0223716 A1 Sep. 10, 2009

(51) Int. Cl.
*E21B 7/06* (2006.01)

(52) U.S. Cl. ..... 175/76; 175/325.5

(58) Field of Classification Search ..... 175/76, 175/325.2, 325.5

See application file for complete search history.

(56) References Cited

U.S. PATENT DOCUMENTS

| | | | | |
|---|---|---|---|---|
| 3,080,924 | A | 3/1963 | Baker et al. | |
| 3,180,436 | A | 4/1965 | Kellner et al. | |
| 3,298,449 | A | 1/1967 | Bachman et al. | |
| 3,595,326 | A | 7/1971 | Claycomb | |
| 3,974,886 | A | 8/1976 | Blake, Jr. | |
| 4,270,619 | A | 6/1981 | Base | |
| 4,284,156 | A | 8/1981 | Carstensen et al. | |
| 4,471,843 | A | 9/1984 | Jones, Jr. et al. | |
| 4,572,305 | A | 2/1986 | Swietlik | |
| 4,635,736 | A | 1/1987 | Shirley | |
| 4,842,083 | A | 6/1989 | Raney | |
| 4,848,488 | A | 7/1989 | Cendre et al. | |
| 4,848,490 | A | 7/1989 | Anderson | |
| 4,947,944 | A | 8/1990 | Coltman et al. | |
| 5,181,576 | A | 1/1993 | Askew et al. | |
| 5,224,558 | A | 7/1993 | Lee | |
| 5,265,684 | A | 11/1993 | Rosenhauch | |
| 5,293,945 | A | 3/1994 | Rosenhauch et al. | |
| 5,318,138 | A | 6/1994 | Dewey et al. | |
| 5,511,627 | A | 4/1996 | Anderson | |
| 5,547,031 | A | 8/1996 | Warren et al. | |
| 5,603,386 | A * | 2/1997 | Webster | 175/76 |
| 6,227,312 | B1 | 5/2001 | Eppink et al. | |
| 6,257,356 | B1 | 7/2001 | Wassell | |
| 6,290,003 | B1 | 9/2001 | Russell | |
| 6,328,119 | B1 | 12/2001 | Gillis et al. | |
| 6,494,272 | B1 | 12/2002 | Eppink et al. | |
| 6,609,579 | B2 | 8/2003 | Krueger et al. | |

(Continued)

FOREIGN PATENT DOCUMENTS

| | | |
|---|---|---|
| GB | 2344122 | 5/2000 |

OTHER PUBLICATIONS

European Search Report issued in EP Application No. 09154242.3 dated Jul. 3, 2009.

*Primary Examiner*—William P Neuder

(57) ABSTRACT

A purely mechanical hydraulic control system includes at least one drilling fluid chamber and a hydraulic fluid chamber. A system pressure spring is deployed in one of the drilling fluid chamber(s) between a positioning piston and a system pressure piston. The spring is disposed to pressurize oil in the hydraulic fluid chamber via applying a spring force to the system pressure piston. When the system is actuated (e.g., via turning on the mud pumps), the positioning piston is urged in place against a stop (e.g., a shoulder) thereby compressing the system pressure spring and pressurizing oil in the hydraulic chamber. The invention advantageously converts highly variable drilling fluid pressure to a near constant pressure hydraulic fluid.

25 Claims, 13 Drawing Sheets

U.S. PATENT DOCUMENTS 6,659,200 B1 * 12/2003 Eppink ..... 175/61
6,668,949 B1 12/2003 Rives
6,732,817 B2 5/2004 Dewey et al.
6,948,572 B2 9/2005 Hay et al.
2001/0045300 A1 11/2001 Fincher et al.
2002/0011358 A1 1/2002 Wassell
2004/0026128 A1 2/2004 Krueger et al.
2006/0207797 A1 9/2006 Dewey et al.

* cited by examiner

DOWNHOLE HYDRAULIC CONTROL SYSTEM

RELATED APPLICATIONS

None.

FIELD OF THE INVENTION

The present invention relates generally to downhole tools, for example, including stabilizers. More particularly, embodiments of this invention relate to a hydraulic control system for providing substantially constant pressure hydraulic fluid in a downhole tool.

BACKGROUND OF THE INVENTION

Various hydraulic control systems are commonly utilized in conventional downhole deployments. For example, one common hydraulic system makes use of the absolute value of a differential fluid pressure between drilling fluid internal to the drill string (or BHA) and drilling fluid in the borehole annulus to perform a tool function (e.g., reset a switch). Differential fluid pressure has also been utilized to actuate one or more blades in an adjustable stabilizer (U.S. Pat. No. 5,318,138). While such applications are commercially serviceable, the use of a differential pressure can be problematic. The pressure differential is known to be a function of various drilling factors, for example, including drilling fluid flow rate, velocity, and viscosity, size of the drill bit nozzles, the longitudinal distance of the hydraulic system from the drill bit, and the borehole diameter. Thus, the differential pressure can (and often does) vary widely within a drilling operation and from one drilling operation to the next. Such pressure variations are known to cause tool reliability issues. Furthermore, the above described hydraulic systems often require that the flow of drilling fluid in the drill string must be essentially stopped and restarted to perform the function.

More complex hydraulic control systems are also commonly utilized, for example, in rotary steering tools to control the radial position of and/or the lateral force applied to each of a plurality of steering blades. Such systems commonly include a hydraulic pumping mechanism (e.g., a cam driven piston pump) and numerous electronically controllable (e.g., solenoid) and pressure relief valves to maintain a constant (or a controllable) hydraulic fluid pressure. While such systems have been reliably used in downhole tools, they tend to be expensive to build and maintain due to their complexity. Therefore, they tend not to be suitable for certain downhole applications There is a need in the art for a relatively inexpensive hydraulic control system for maintaining constant or near-constant hydraulic pressure. Such a system advantageously does not require a pumping mechanism or electronic controllable valves (e.g., solenoid valves) or other controllable components.

SUMMARY OF THE INVENTION

The present invention addresses the above described need for an improved hydraulic control system for use in downhole tools. Exemplary embodiments in accordance with the invention include at least one drilling fluid chamber and a hydraulic fluid chamber. A system pressure spring is deployed in one of the drilling fluid chamber(s) between a positioning piston and a system pressure piston. The spring is disposed to pressurize oil in the hydraulic fluid chamber via applying a spring force to the system pressure piston. When the system is actuated (e.g., via turning on the mud pumps), the positioning piston is urged in place against a stop (e.g., a shoulder) thereby compressing the system pressure spring and pressurizing oil in the hydraulic chamber. As long as the drilling fluid pressure (mud pump pressure) remains above a minimum threshold, (as is the case in a typical drilling operation), the positioning piston remains in place against the stop and the pressure in the hydraulic chamber remains approximately constant.

Exemplary embodiments of the present invention may advantageously provide several technical advantages. For example, exemplary embodiments of this invention advantageously convert highly variable drilling fluid pressure (mud pump pressure) in a downhole tool to a near constant pressure hydraulic fluid (as compared to the variable drilling fluid pressure). Moreover the inventive hydraulic system is purely mechanical. It does not include any electronic and/or electrically controllable components, for example, including microprocessors, sensors, and/or electronically actuatable valves. As such, the invention tends to be more reliable than prior art hydraulic systems.

In one aspect the present invention includes a downhole tool. The downhole tool includes a substantially cylindrical drill collar having a through bore and a first drilling fluid chamber in fluid communication with drilling fluid in the through bore. The first drilling fluid chamber is located between a positioning piston and a port connecting the first drilling fluid chamber to the through bore. The positioning piston is disposed to reciprocate between first and second opposed positions and is in the first position when a drilling fluid pressure in the through bore is greater than a predetermined threshold. The tool further includes a hydraulic fluid chamber and a system pressure spring deployed between the positioning piston and a system pressure piston. The system pressure piston is in contact with the hydraulic fluid chamber. The system pressure spring is disposed to pressurize hydraulic fluid in the hydraulic fluid chamber when the positioning piston is in the first position.

In another aspect the invention includes a downhole tool. The tool includes a substantially cylindrical through bore and a hydraulic module in fluid communication with a hydraulic replenishing system. The hydraulic replenishing system is disposed to replenish hydraulic fluid in the hydraulic module. A hydraulic fluid channel is disposed between a hydraulic chamber in the replenishing system and a hydraulic chamber in the hydraulic module. The fluid channel includes a check valve and a push rod deployed therein. The check valve is disposed to permit fluid flow from the hydraulic module to the replenishing system. The push rod is deployed between a piston in the hydraulic module and the check valve. The piston in the hydraulic module is disposed to urge the push rod into contact with the check valve thereby opening the check valve when a fluid volume in the hydraulic module is below a predetermined threshold. Opening the check valve allows hydraulic fluid to flow down a pressure gradient from the replenishing system to the hydraulic module.

In a further aspect the invention includes a hydraulic module for use in a downhole tool. The hydraulic module is disposed to provide substantially constant pressure hydraulic fluid and includes first and second drilling fluid chambers and a hydraulic fluid chamber. The first drilling fluid chamber is in fluid communication with drilling fluid inside the tool and the second drilling fluid chamber is in fluid communication with drilling fluid outside the tool. A positioning piston is deployed between the first and second drilling fluid chambers and is disposed to displace between first and second longitudinally opposed positions. The first position is adjacent a stop in the second drilling fluid chamber and the second position is adjacent an inlet port disposed to permit drilling fluid in the through bore to enter the first drilling fluid chamber. A system pressure piston is deployed between the second drilling fluid chamber and the hydraulic fluid chamber. A system pressure spring is deployed in the second drilling fluid chamber. The system pressure spring is loaded between the positioning piston and the system pressure piston and is disposed to pressurize hydraulic fluid in the hydraulic fluid chamber when the positioning piston is in the first position.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
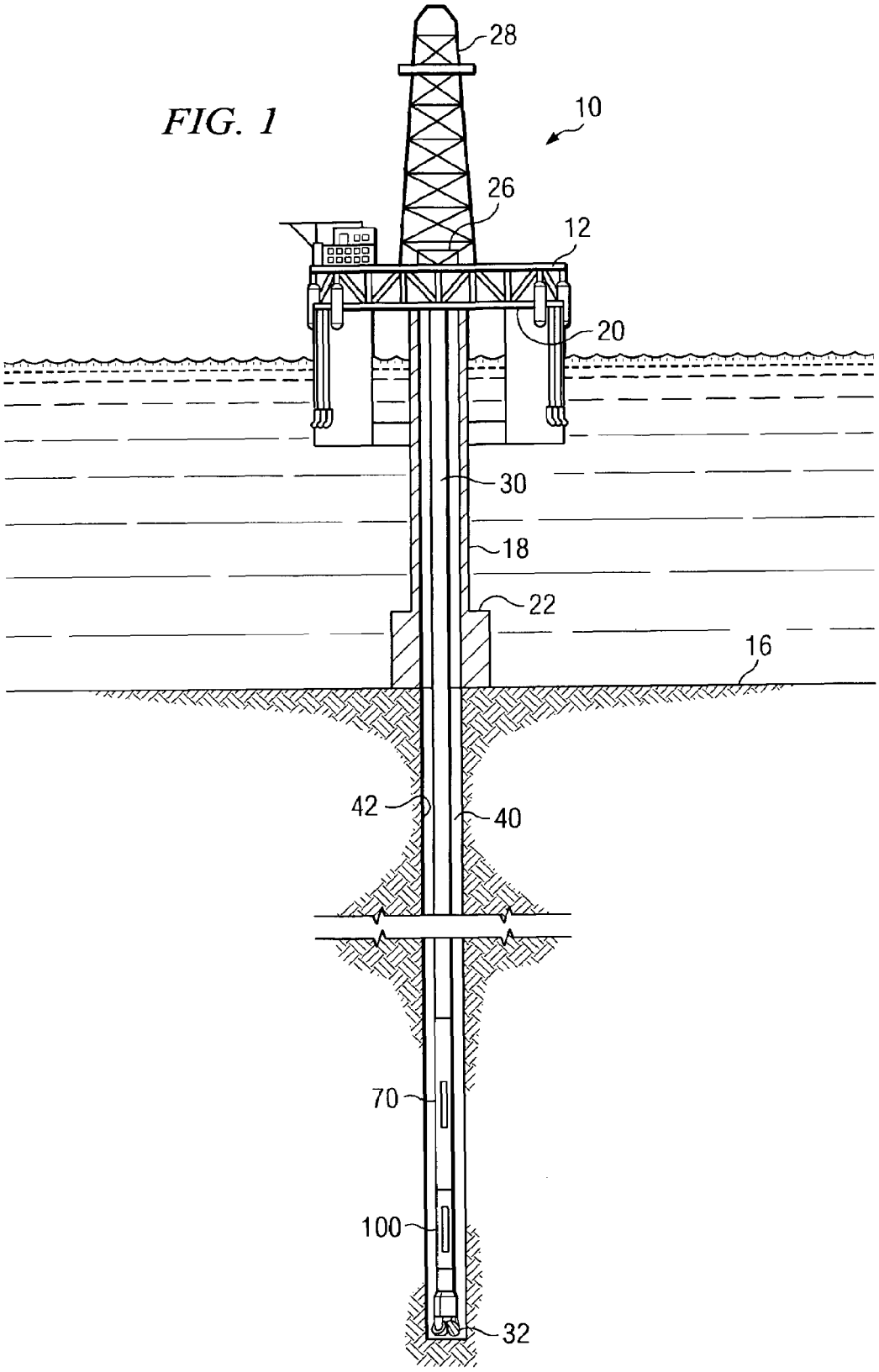
FIG. 1 depicts a drilling rig on which exemplary embodiments of the present invention may be deployed.

Referring first to FIGS. 1 through 10B, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 10B may be described herein with respect to that reference numeral shown on other views.

FIG. 1 illustrates a drilling rig 10 suitable for utilizing exemplary stabilizer and hydraulic control system deployments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a rotatable stabilizer 100 in accordance with one exemplary embodiment of the invention deployed just above the drill bit 32. Exemplary embodiments of stabilizer 100 may advantageously be utilized as a near-bit stabilizer in combination with a steering tool 70 (e.g., including a two- or three-dimensional rotary steerable tool), although the invention is not limited in this regard.

It will be understood by those of ordinary skill that the present invention is not limited to use with a semisubmersible platform 12 as illustrated in FIG. 1. This invention is equally well suited for use with any kind of subterranean drilling operation, either offshore or onshore. While exemplary embodiments of this invention are described below with respect to near-bit stabilizer embodiments, it will also be appreciated that the invention is not limited in this regard. Embodiments of the invention may include substantially any rotatable downhole stabilizer including, for example, a bottom hole assembly (BHA) stabilizer.

Figure 2:
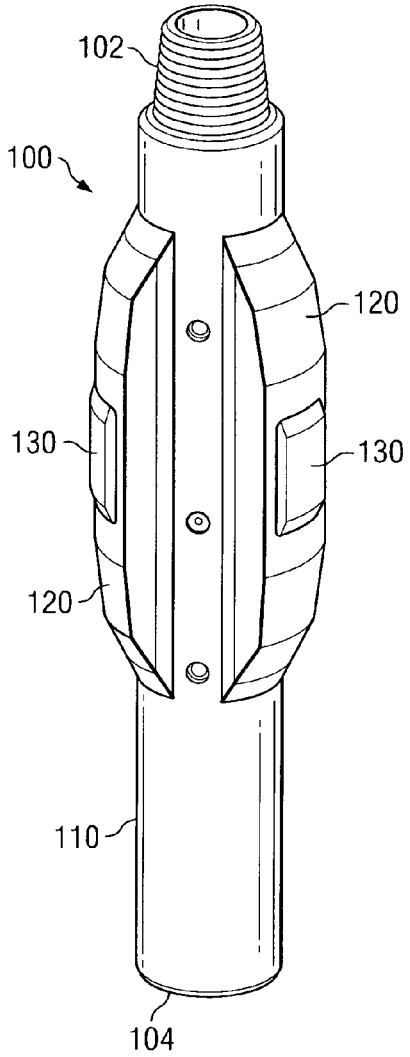
FIG. 2 is a perspective view of one exemplary embodiment of the invention shown on FIG. 1 depicted as a near-bit stabilizer.

Turning now to FIG. 2, one exemplary embodiment of stabilizer 100 from FIG. 1 is illustrated in perspective view. In the exemplary embodiment shown, stabilizer 100 is substantially cylindrical and includes threaded ends 102 and 104 for connecting the stabilizer with a drill string or with other bottom hole assembly (BHA) components (e.g., connecting with the drill bit 32 at end 104 and a steering tool 70 at end 102 as shown on FIG. 1). Stabilizer 100 is thus configured to rotate with the drill string. Stabilizer 100 further includes a substantially cylindrical housing 110 and at least three fixed blades 120. In the exemplary embodiment shown blades 120 are integral with the housing 110, however, the invention is not limited in this regard. Each of the blades 120 includes at least one piston 200 (shown, for example, on FIGS. 3A and 3B) disposed to extend radially outward from and retract radially inward towards the blade 120. As described in more detail below with respect to FIGS. 3A through 6, pistons 200 are urged radially outward via hydraulic force and are simultaneously urged radially inward via spring force. In the exemplary embodiment shown, each blade 120 includes a piston cover 130 deployed over the piston. Piston covers 130 are disposed to contact the borehole wall upon extension of the piston 200 and may advantageously be fabricated from and/or coated with a conventional wear resistant material. The invention, however, is not limited to embodiments including a wear pads or piston covers 130 as shown on FIG. 2.

The exemplary stabilizer embodiment 100 shown on FIGS. 1 and 2 is configured as a near-bit stabilizer and is intended to be deployed in a BHA immediately above the drill bit, e.g., between a drill bit and a steering tool in a point-the-bit steering tool configuration. While the invention is not limited to near-bit stabilizer embodiments, and may be utilized substantially anywhere in the BHA, such near-bit stabilizer embodiments are particularly advantageous. For example, stabilizer 100 is configured to quickly accommodate variations in the borehole diameter without losing contact with the borehole wall (due to the extendable and retractable pistons). Continual contact with the borehole wall tends to minimize radial shock and vibration levels and therefore tends to minimize BHA damage during drilling. Continual contact with the borehole wall also tends to improve the steerability of rotary steerable tools used in conjunction with the inventive stabilizer.

Stabilizer 100 is intended to continually contact the borehole wall during operation. In combination, the pistons 200 automatically and continuously maintain the center of the stabilizer 100 at or near the center of the borehole without any resetting, stopping and starting of drilling, and without any electronic (smart) control. The inventive stabilizer 100 is purely mechanical, using a differential force in the pistons 200 to push against the formation and thereby center the tool. A balance of forces determines the radial position of each piston; a hydraulic force urging the piston outward, a spring force urging the piston inward, and external forces acting on the tool (e.g., the force of the borehole wall urging the pistons inward). Moreover, the stabilizer 100 is configured such that a balance of forces between the pistons causes the tool to be continuously centered during rotation of the tool in the borehole. This balance of forces is discussed in more detail below with respect to FIGS. 5A, 5B, and 6.

Figure 3A:
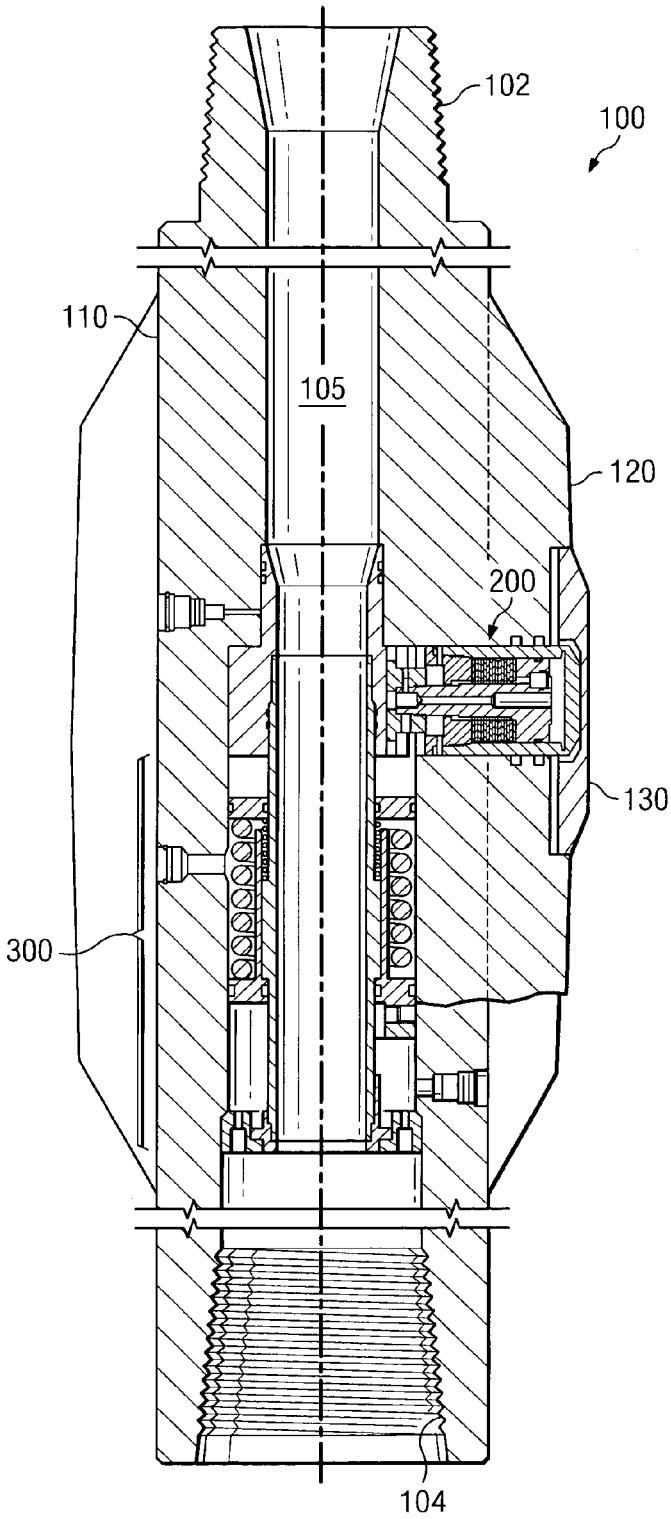
FIGS. 3A and 3B depict, in longitudinal cross section, the exemplary near-bit stabilizer embodiment shown on FIG. 2 in which a piston is shown fully extended (FIG. 3A) and fully retracted (FIG. 3B).
Figure 3B:
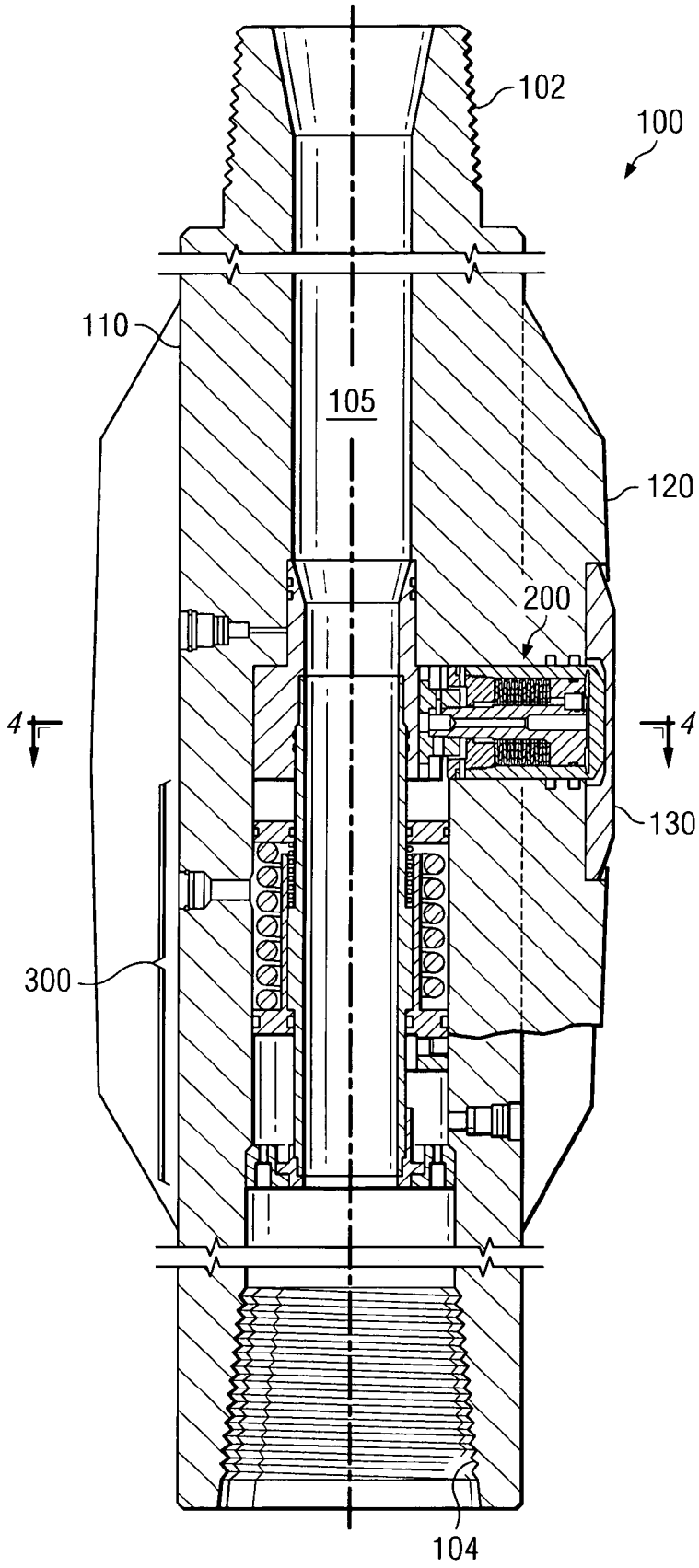
Figure 4:
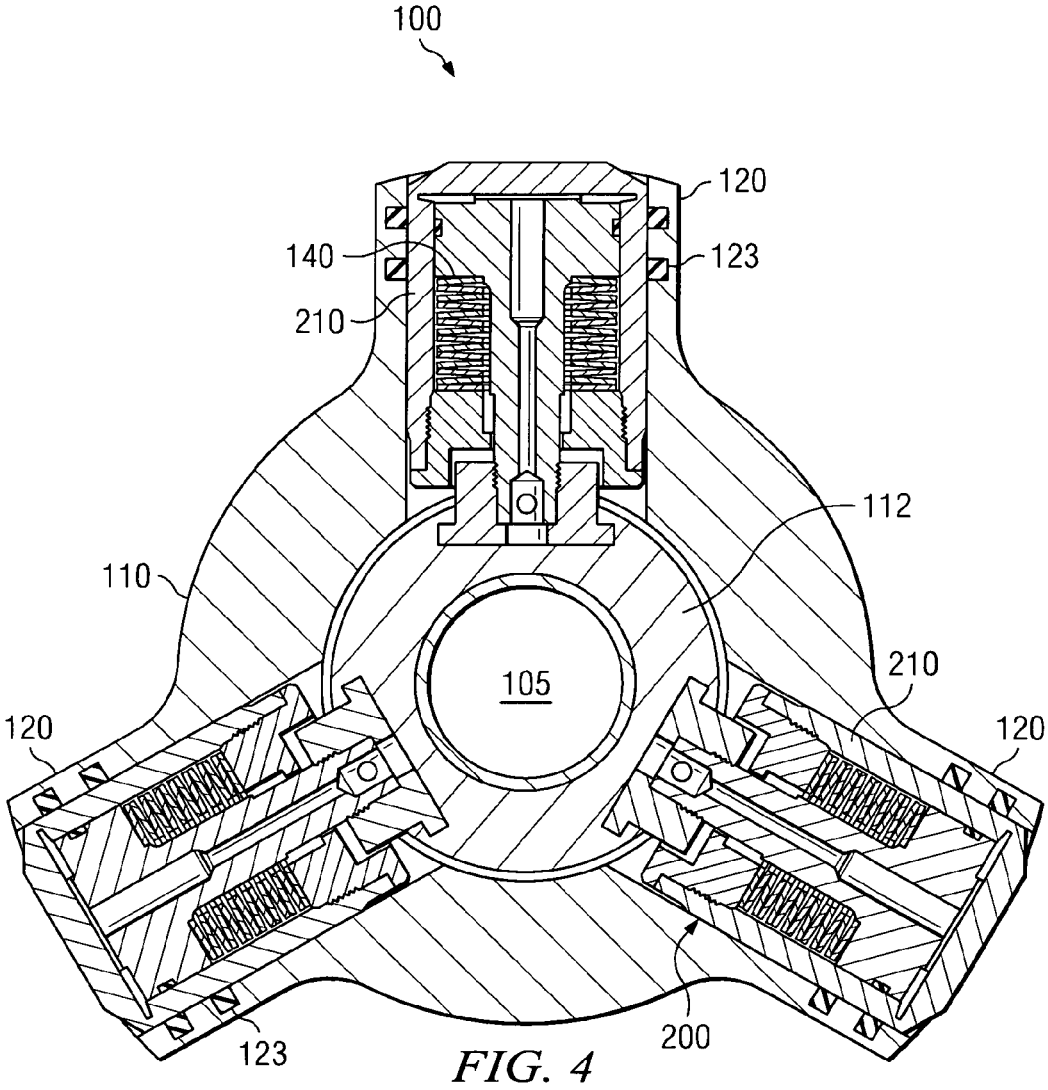
FIG. 4 depicts a circular cross section of the embodiment shown on FIG. 3B but not including piston covers 130.

Turning now to FIGS. 3A, 3B, and 4, stabilizer 100 is shown in longitudinal cross section with piston 200 shown fully extended (FIG. 3A) and fully retracted (FIG. 3B) and in circular cross section with the pistons 200 shown fully retracted (FIG. 4). As described above, steering tool 100 includes at least three fixed blades 120 integral with the tool housing 110 (three in the exemplary embodiment shown on FIG. 4). It will be understood that the invention is not limited to embodiments in which the blades 120 are integral with the housing 110. The blades 120 may, of course, be fixed to the housing 100 via other known mechanical coupling techniques. The fixed blades 120 are typically, although not necessarily, sized and shaped such that an effective outside diameter of the blades 120 is in the range from about 0.005 to 0.5 inch under gage (i.e., smaller) than an expected borehole diameter. Each fixed blade 120 includes at least one piston 200 disposed to extend radially outward (as shown on FIG. 3A) into contact with a borehole wall. The pistons 200 are typically, although not necessarily, configured to have a full outward extension beyond an outer surface of the blade 120 in the range from about 0.25 to about 1 inch. Steering tool 100 further includes hydraulic module 300 for providing high pressure hydraulic fluid to the pistons 200. The hydraulic fluid is intended to urge the pistons radially outward against a spring bias as described in more detail with respect to FIGS. 5A, 5B, and 6. Exemplary hydraulic module 300 embodiments are described in more detail below with further reference to FIGS. 8A through 10B.

Figure 5A:
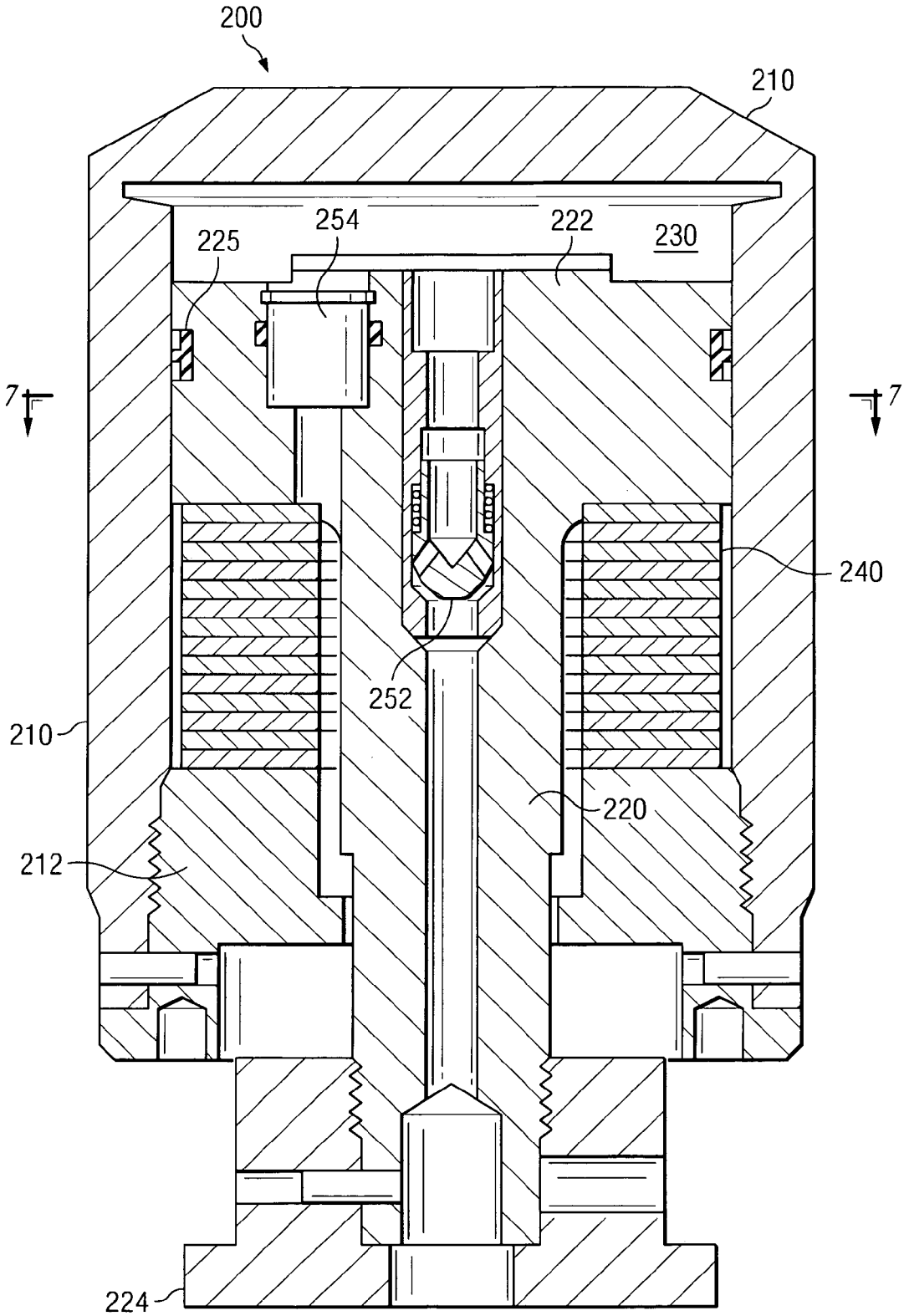
FIGS. 5A and 5B depict an exemplary piston embodiment in accordance with the invention in which the piston is shown fully extended (FIG. 5A) and fully retracted (FIG. 5B).
Figure 5B:
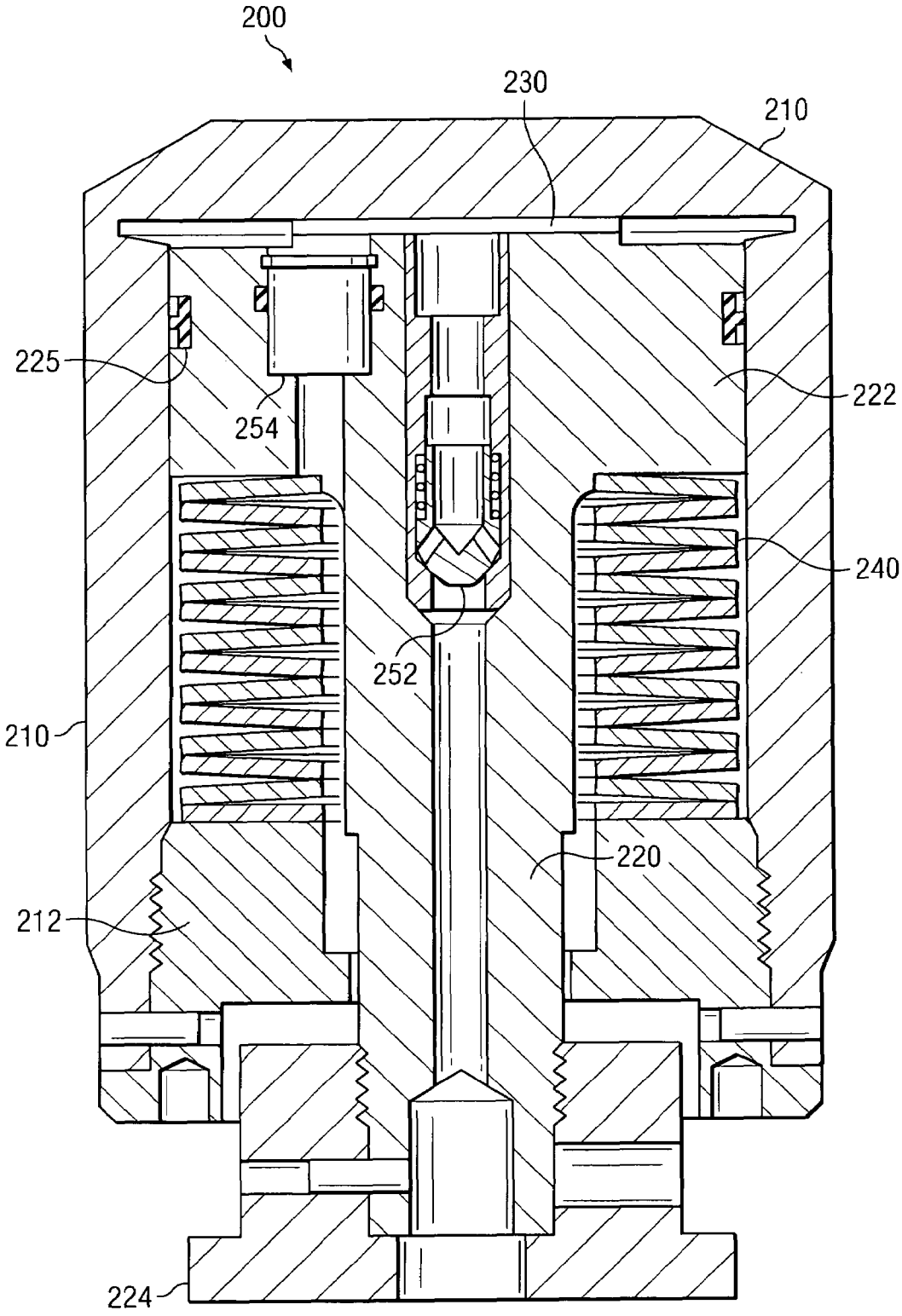

With further reference now to FIGS. 5A and 5B, one exemplary embodiment of piston 200 is shown in greater detail (FIG. 5A shows the piston fully extended while FIG. 5B shows the piston fully retracted). In the exemplary embodiment shown piston 200 includes a piston housing 210 deployed about a support 220. Piston housing 210 may be configured to engage piston cover 130 (e.g., as shown on FIGS. 3A and 3B) or alternatively may be configured to directly contact the borehole wall (e.g., as shown on FIG. 6). The invention is not limited in these regards.

Support 220 includes a support top 222 deployed in the piston housing 210 and a support base 224 rigidly connected to a piston assembly locking sleeve 112 which is deployed in and fixed to the steering tool body 110 (see FIG. 4). An outer surface of the support top 222 is sealingly engaged with an inner surface of housing 210, for example, as shown at 225. An outer surface of the piston housing 210 is also sealingly engaged with the blade 120 as shown at 123 (FIG. 4). Piston housing 210 and preload sleeve 212 are disposed to move radially outward relative to the support 220 as shown in FIG. 5A. Piston 200 further includes a hydraulic chamber 230 disposed to be filled with high pressure hydraulic fluid (supplied for example via hydraulic module 300 shown on FIGS. 3A and 3B). In the exemplary embodiment shown a spring 240 (e.g., a Bellville spring) is deployed between the support top 222 and preload sleeve 212, biasing the piston housing 210 radially inward towards support top 222 (the fully retracted position shown in FIG. 5B). Filling the hydraulic chamber 230 with hydraulic fluid extends the piston housing 210 outward thereby closing spring 240 against its bias.

The force applied radially outward by each of the pistons may be expressed mathematically, for example, as follows:

$$F_P = F_H - F_S \qquad \text{Equation 1}$$

where $F_P$ represents the outward force of the piston, $F_H$ represents the hydraulic force urging the piston radially outward, and $F_S$ represents the spring force urging the piston radially inward. In preferred embodiments, the hydraulic force $F_H$ is substantially constant while the spring force $F_S$ increases approximately linearly as the piston is extended against the bias of spring 240 (by substantially constant it is meant that variations in the hydraulic force are much less than the increase and decrease in the spring force caused by extension and retraction of the piston 200). In such embodiments, the outward force of the piston $F_P$ decreases approximately linearly with increasing extension thereof (due to the increasing spring force and the substantially constant hydraulic force). It will thus be understood that a fully retracted piston exerts a significantly greater outward force than a fully extended piston. In one advantageous embodiment, the spring force $F_S$ is near zero when the piston is fully retracted (as compared to the spring force when the piston is fully extended) and the piston force $F_P$ is near zero when the piston is fully extended (as compared to the piston force when the piston is fully retracted).

Figure 6:
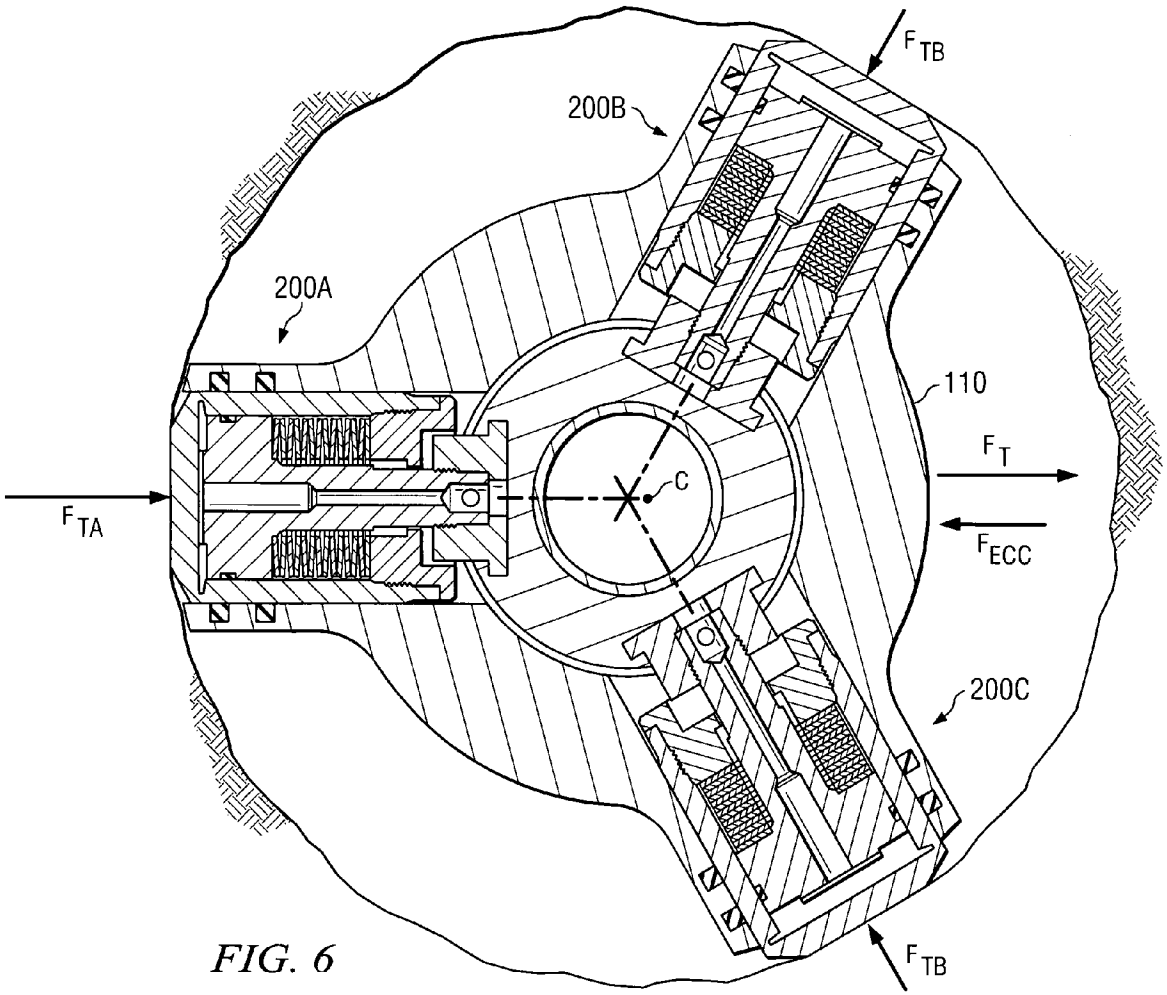
FIG. 6 depicts, in circular cross section, the embodiment show on FIG. 4 deployed off-center in a borehole.

Turning now to FIG. 6, steering tool 100 is shown in circular cross section deployed off-center (eccentered) in a borehole. In the exemplary embodiment shown, piston 200A is fully retracted while pistons 200B and 200C are shown fully extended. During the course of drilling, lateral forces (e.g., lateral shocks and vibrations) are commonly encountered and are known to sometimes temporarily eccenter the BHA assembly (including conventional stabilizers). Such eccentering of the BHA components is especially problematic in oversized boreholes in which conventional fixed stabilizer blades no longer continually contact the borehole wall. As described above, stabilizer embodiments in accordance with this invention advantageously tend to resist eccentering and continually and automatically re-center themselves (in the event they are off-center). This "center seeking" behavior is the result of a balance of forces between the pistons (e.g., pistons 200A-C in FIG. 6).

With continued reference to FIG. 6, the outward forces of each of the pistons 200A-C on the borehole wall result in equal and opposite radially inward forces acting on the tool body 110. These forces are designated as $F_{TA}$, $F_{TB}$, and $F_{TC}$ in FIG. 6. As shown, the magnitude of force $F_{TA}$ at piston 200A is significantly greater than the magnitudes of forces $F_{TB}$ and $F_{TC}$ at 200B and 200C (since piston 200A is retracted and pistons 200B and 200C are extended). As a result, the sum of forces $F_{TA}$, $F_{TB}$, and $F_{TC}$ (designated as $F_T$ in FIG. 6) is non-zero and in the exemplary embodiment shown is directed such that it urges the tool 100 radially inward towards the center C of the borehole. If $F_T$ is greater than the centrifugal force $F_{ECC}$ urging tool body 110 radially outward away from the center of the borehole, then the stabilizer 100 tends to automatically re-center itself during rotation in the borehole. Those of ordinary skill in the art will readily recognize that eccentric rotation of tool 100 in the borehole results in a centrifugal force $F_{ECC}$ urging tool body 110 radially outward (away from the center of the borehole).

It will be understood that FIG. 6 is schematic in nature and depicts a simplified scenario. In actuality the drill string (and therefore stabilizer 100) is rotating and/or whirling in the borehole. Therefore the re-centering process described above tends to be dynamic. Notwithstanding, so long as the magnitude of force $F_T$ is greater than the magnitude of force $F_{ECC}$, then stabilizer 100 advantageously tends to continuously and automatically "seek" the center of the borehole. Stated another way, the above described balance of forces between the pistons tends to cause under-extended (over-retracted) pistons to extend relative to overextended pistons. This "extending" of the under-extended pistons tends to re-center the stabilizer 100.

In order for the stabilizer 100 to effectively re-center, the pistons 200 must be able to exert sufficient force to overcome the centrifugal force acting on the tool body (e.g., in the exemplary embodiment shown on FIG. 6: $F_{TA}$ must be greater than $F_{ECC}$). This can be achieved, for example, by utilizing a hydraulic module 300 (FIGS. 3A and 3B) providing sufficient hydraulic pressure. In one advantageous embodiment, the pistons 200 are configured such that the spring 240 exerts a spring force at any extension that is greater than or equal to the centrifugal force acting on the tool 100 due to eccentric rotation of the tool 100 in the borehole. This may be expressed mathematically, for example, as follows:

$$F_S \geqq F_{ECC} \qquad \text{Equation 2}$$

where $F_S$ represents the spring force and $F_{ECC}$ represents the centrifugal force acting on the tool due to eccentric rotation in the borehole. If piston 200 is configured such that the spring force is near zero when the piston is fully retracted then the spring force $F_S$ may be expressed mathematically, for example, as follows:

$$F_S = K_S r_{piston} \qquad \text{Equation 3}$$

where $K_S$ represents the spring constant (also referred to herein as the spring rate) and $r_{piston}$ represents the outward extension of the piston from the fully retracted position against the bias of spring 240. The centrifugal force due to eccentric rotation of the tool 100 in the borehole may be expressed mathematically, for example, as follows:

$$F_{ECC} = m\omega^2 r_{eccenter} \qquad \text{Equation 4}$$

where m represents the mass of the tool rotating off center, ω represents the angular velocity of the tool in units of radians, and $r_{eccenter}$ represents the tool offset from the center of the borehole (i.e., the radial distance between the center of the tool and the center of the borehole). Equation 1 may then be re-written as follows:

$$K_S r_{piston} \geqq m\omega^2 r_{eccenter} \qquad \text{Equation 5}$$

In general, the outward extension of the piston $r_{piston}$ may be thought of as being approximately equal to the tool offset $r_{eccenter}$. Thus, in the above described exemplary embodiment, spring 240 is configured to have a spring constant $K_S$ that exceeds the maximum expected $m\omega^2$ based on known/expected service conditions. By pre-selecting the spring constant, optimum centering can be achieved for predetermined tool parameters and service conditions (weight and an expected maximum rpm). For example, for a tool (or BHA) having a mass of about 1300 lbs and a maximum serviceable rotation rate of about 300 rpm, an advantageous spring constant may be greater than about 3300 lbs/in.

Figure 7:
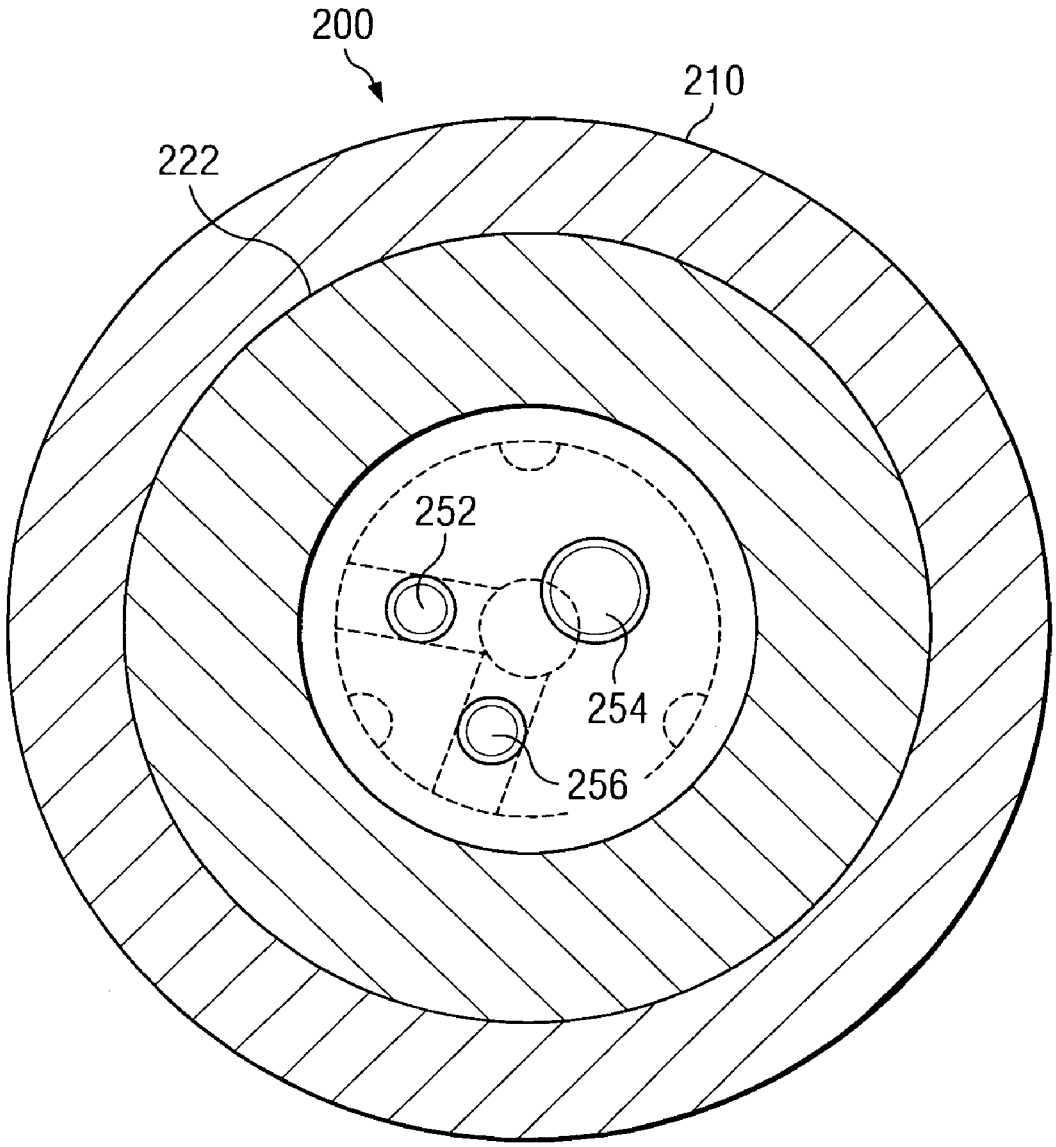
FIG. 7 depicts a circular cross section of the piston embodiment shown on FIG. 5A.

Turning now to FIG. 7, one exemplary embodiment of piston 200 is shown in circular cross section. The exemplary embodiment shown includes three parallel flow paths between hydraulic module 300 (FIGS. 3A and 3B) and hydraulic fluid chamber 230 (FIGS. 5A and 5B). The first flow path includes a check valve 252 deployed therein, the check valve 252 being disposed to permit flow from the hydraulic module 300 to the hydraulic fluid chamber 230. Reverse flow is blocked. The second flow path includes a flow restrictor 254 deployed therein. The flow restrictor allows (but restricts) flow volume in both directions. The third flow path includes a pressure relief valve 256 deployed therein. The pressure relief valve is disposed to permit flow from the hydraulic fluid chamber 230 to the hydraulic module 300 only when the hydraulic pressure in the hydraulic fluid chamber 230 exceeds a predetermined pressure.

The fluid flow configuration described above with respect to FIG. 7 advantageously tends to improve piston performance during operation in a borehole. When there is essentially no external force acting on the piston 200, it extends outward rapidly as pressurized hydraulic fluid moves unimpeded through the check valve 252. However, when an inward force is applied to the piston 200 it moves inward slowly as the hydraulic fluid is forced back towards the hydraulic module through the flow restrictor 254 (reverse flow through the check valve 252 is blocked). Such an arrangement enhances the ability of the stabilizer to remain centered in the borehole as the flow restrictor 254 acts to effectively dampen external shocks and forces that would otherwise rapidly eccenter the tool. In the exemplary embodiment described in FIG. 7, pressure relief valve 256 bypasses the check valve 252 thereby allowing high velocity fluid flow from chamber 230 to hydraulic module, which allows for rapid retraction of the piston 200, in the event of a severe external shock (an external force with a magnitude above a predetermined threshold). The pressure relief valve is therefore intended to minimize piston damage (e.g., damage to the seals) when severe external forces are encountered. While the use of pressure relief valve 256 tends to be advantageous, the invention is not limited in this regard. Nor is the invention limited to the use of any such parallel flow paths as depicted on FIG. 7.

Figure 8A:
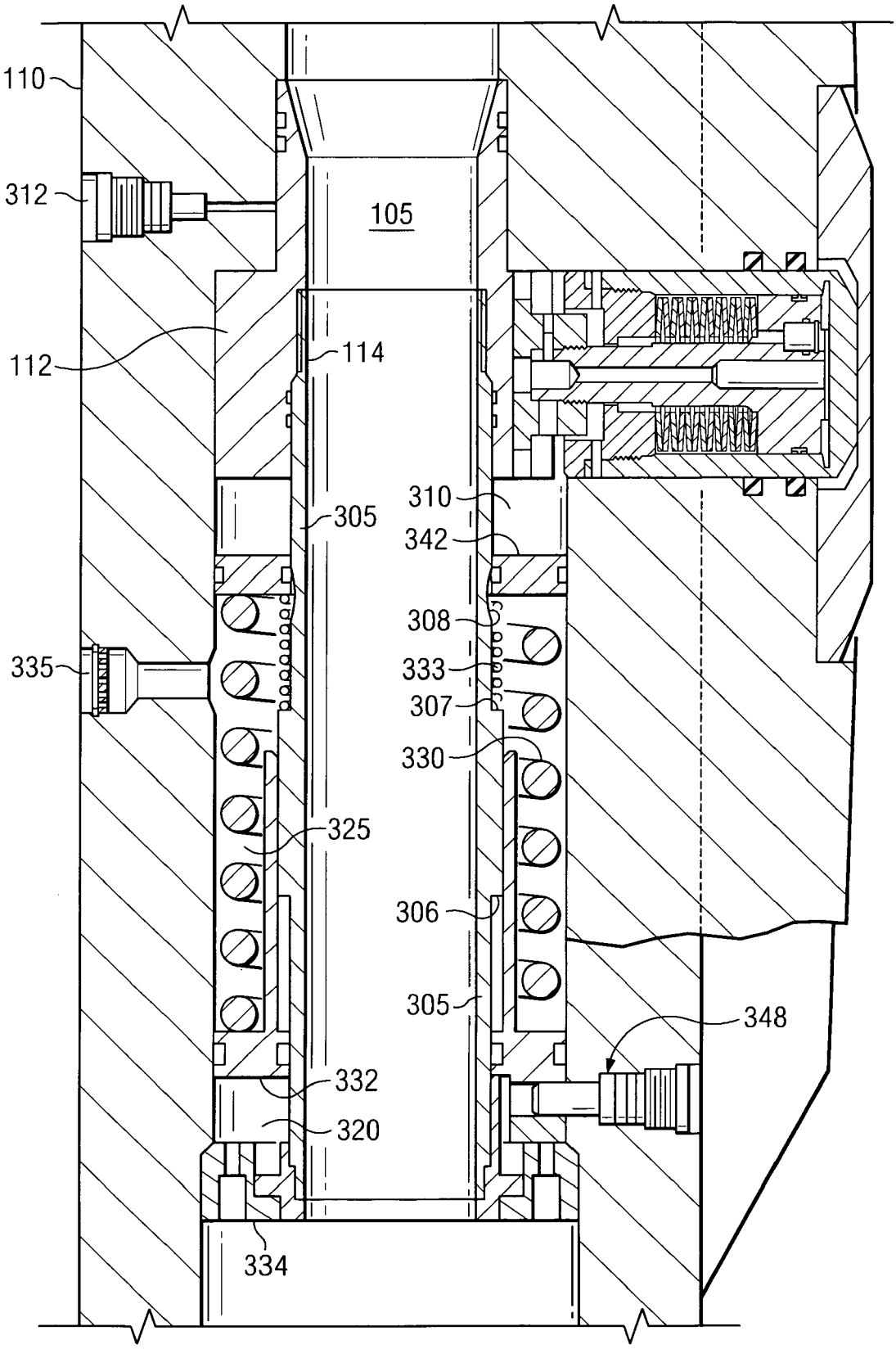
FIGS. 8A and 8B depict, in longitudinal cross section, a portion of the exemplary near-bit stabilizer embodiment shown on FIGS. 3A and 3B having a non-activated (FIG. 8A) and activated (FIG. 8B) hydraulic system.
Figure 8B:
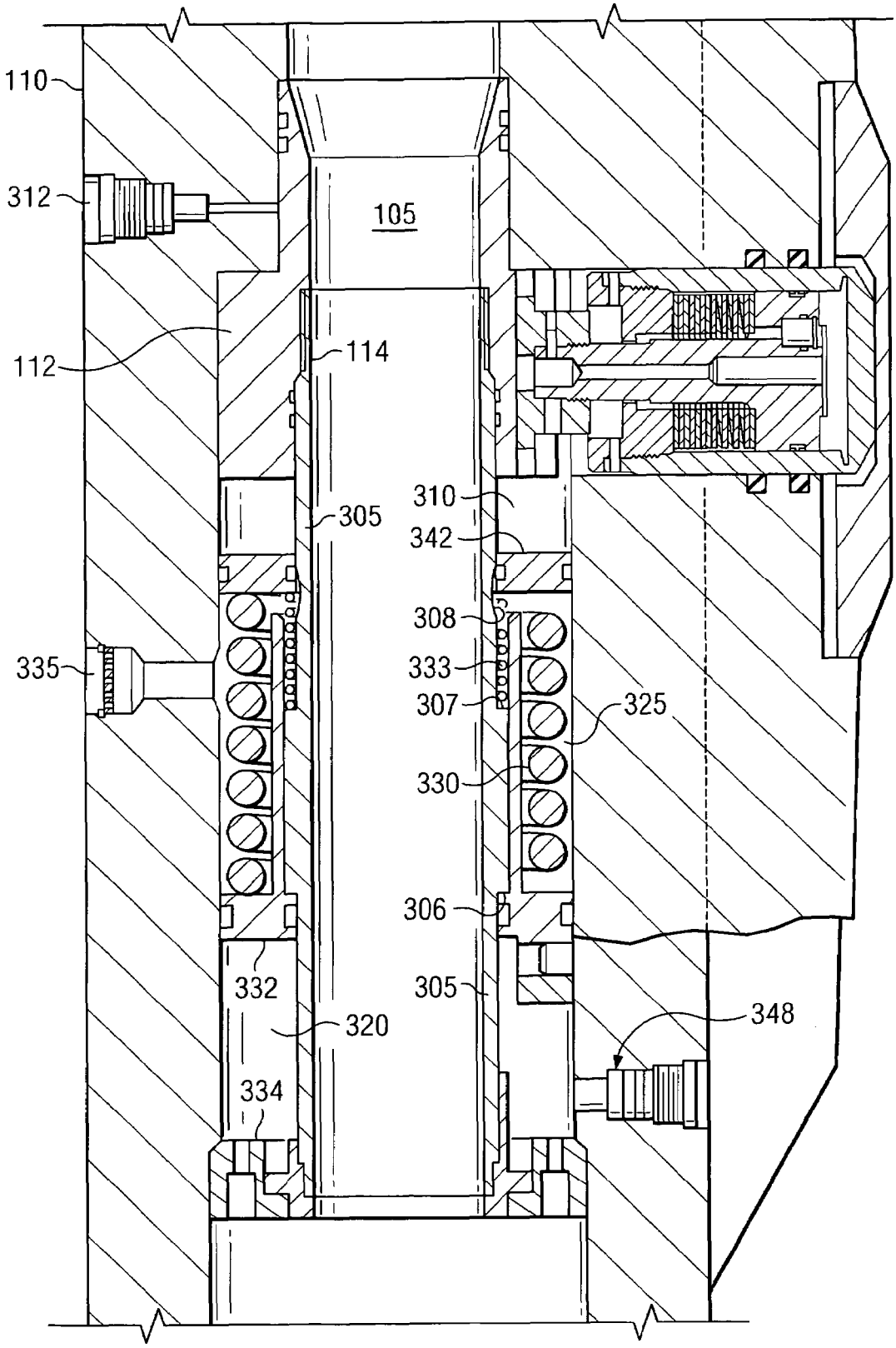

With reference now to FIGS. 8A and 8B, one exemplary embodiment of hydraulic module 300 is described in more detail. While hydraulic module 300 is shown deployed in a stabilizer, it will be appreciated that hydraulic modules in accordance with the present invention may be deployed in any downhole tool in which substantially constant pressure hydraulic fluid is desirable. In FIG. 8A, hydraulic module 300 is shown de-activated, while in FIG. 8B hydraulic module 300 is shown activated (FIGS. 3A and 3B also depict an activated hydraulic module 300). Hydraulic module 300 is configured to convert highly variable drilling fluid pressure (mud pump pressure) in through bore 105 to a near constant pressure hydraulic fluid (by near constant it is meant that the pressure variation in the hydraulic oil is insignificant as compared to the pressure variation in the drilling fluid in through bore 105). In the exemplary embodiment shown, module 300 includes a substantially annular hydraulic fluid chamber 310 and first and second annular drilling fluid chambers 320 and 325 (it will be understood that the invention is not limited to annularly shaped hydraulic and drilling fluid chambers).

Chambers 310, 320, and 325 are located radially between an outer surface of sleeve 305 and an inner surface of cylindrical housing 110. In the exemplary embodiment shown, sleeve 305 is connected to piston assembly locking sleeve 112 via a tongue and groove connection shown at 114. The invention is not limited in this regard.

Chamber 310 is typically filled with hydraulic oil, for example, via port 312. Drilling fluid chamber 320 is in fluid communication with drilling fluid being pumped down through bore 105 (in the interior of the tool 100). Drilling fluid chamber 320 extends axially from a positioning piston 332 (on an upper end) to a drilling fluid inlet port 334 (on a lower end). Drilling fluid chamber 325 is in fluid communication with drilling fluid exterior to the tool and extends axially from a system pressure piston 342 (on an upper end) to positioning piston 332 (on the lower end). System pressure piston 342 is deployed between hydraulic fluid chamber 310 and drilling fluid chamber 325.

With continued reference to FIGS. 8A and 8B, hydraulic module 300 further includes a system pressure spring 330 deployed in drilling fluid chamber 325. Spring 330 is located axially between system pressure piston 342 and a positioning piston 332. In the exemplary embodiment shown, positioning piston 332 is disposed to reciprocate axially between the drilling fluid inlet port 334 (as shown on FIG. 8A) and an outer shoulder 306 of sleeve 305 (as shown on FIG. 8B). Prior to activating the hydraulic module 300, system pressure spring 330 urges the positioning piston 332 into contact with the drilling fluid inlet port 334 (FIG. 8A) where it is held securely in place via shear pin 348. The shear pin 348 is configured to shear at a predetermined mud pump pressure. Thus, in the exemplary embodiment shown, the fluid in hydraulic chamber 310 is not pressurized until a predetermined drilling fluid pressure is exceeded (e.g., when the mud pumps are turned on and drilling commences). The use of shear pin 348 advantageously enables the pistons 200 (FIGS. 3A and 3B) to remain retracted (under the bias of Bellville spring 240) while the tool 100 is tripped into the borehole. Such retraction of the pistons 200 tends to promote easy trip in (when under gage fixed blades 120 are utilized as described above) and also reduces the likelihood of piston damage during trip in. Notwithstanding the above described advantages, the invention is not limited to embodiments including a shear pin 348 arrangement.

With reference again to FIG. 8B, after pin 348 is sheared, positioning piston 332 moves upwards into contact with shoulder 306 under the influence of drilling fluid pressure as drilling fluid chamber 320 is filled. Such movement of the positioning piston 332 compresses system pressurizing spring 330, which urges system pressure piston 342 upwards and thereby pressurizes the hydraulic oil in chamber 310. As long as the drilling fluid pressure (mud pump pressure) remains above a minimum threshold, (as is the case in a typical drilling operation), positioning piston 332 remains in place against shoulder 306 and the hydraulic pressure in chamber 310 remains approximately constant. In the exemplary embodiment shown, hydraulic module 300 further includes an exhaust port 335 through which drilling fluid may enter and exit drilling fluid chamber 325. Upon activation of the hydraulic module 300 (e.g., via turning on the mud pumps as described above), excess drilling fluid in chamber 325 exits the tool via port 335 as piston 332 compresses system pressure spring 330. Upon deactivation of the hydraulic module 300 (e.g., when the mud pumps are turned off), drilling fluid enters chamber 325 as spring 330 urges piston 332 towards inlet port 334.

As described above with respect to FIG. 7, BHA tools often experience severe external shocks. For example, shock levels in the range of 1000 G on each axis and vibration levels of 50 G root mean square are sometimes encountered. Use of a pressure relief valve in the pistons (as described above with respect to FIG. 7) is one way such shocks can be accommodated. Exemplary embodiments of hydraulic module 300 may also be configured to accommodate external shocks. For example, in the exemplary embodiment shown FIGS. 8A and 8B, annular sleeve 305 includes an over pressure relief groove 308 formed therein. In the event of a sudden increase in system pressure (in chamber 310), piston 342 translates towards system pressure spring 330 allowing excess system pressure to exhaust through groove 308 into drilling fluid chamber 325. Exemplary embodiments of hydraulic module 300 may also include a secondary spring 333 deployed between the system pressure piston 342 and shoulder 307 of sleeve 305. Secondary spring 333 is configured to apply a nominal force to system pressure piston 342 thereby preventing the piston 342 from translating into the groove 309 when the hydraulic module 300 is deactivated (FIG. 8A). This nominal force also maintains a relatively small positive pressure (as compared to the fully activated pressure) on the hydraulic oil in chamber 310, which is intended maintain a positive pressure on various seals in chamber 310 and piston 200 and prevent contamination of the hydraulic oil with exterior drilling fluid.

Figure 9A:
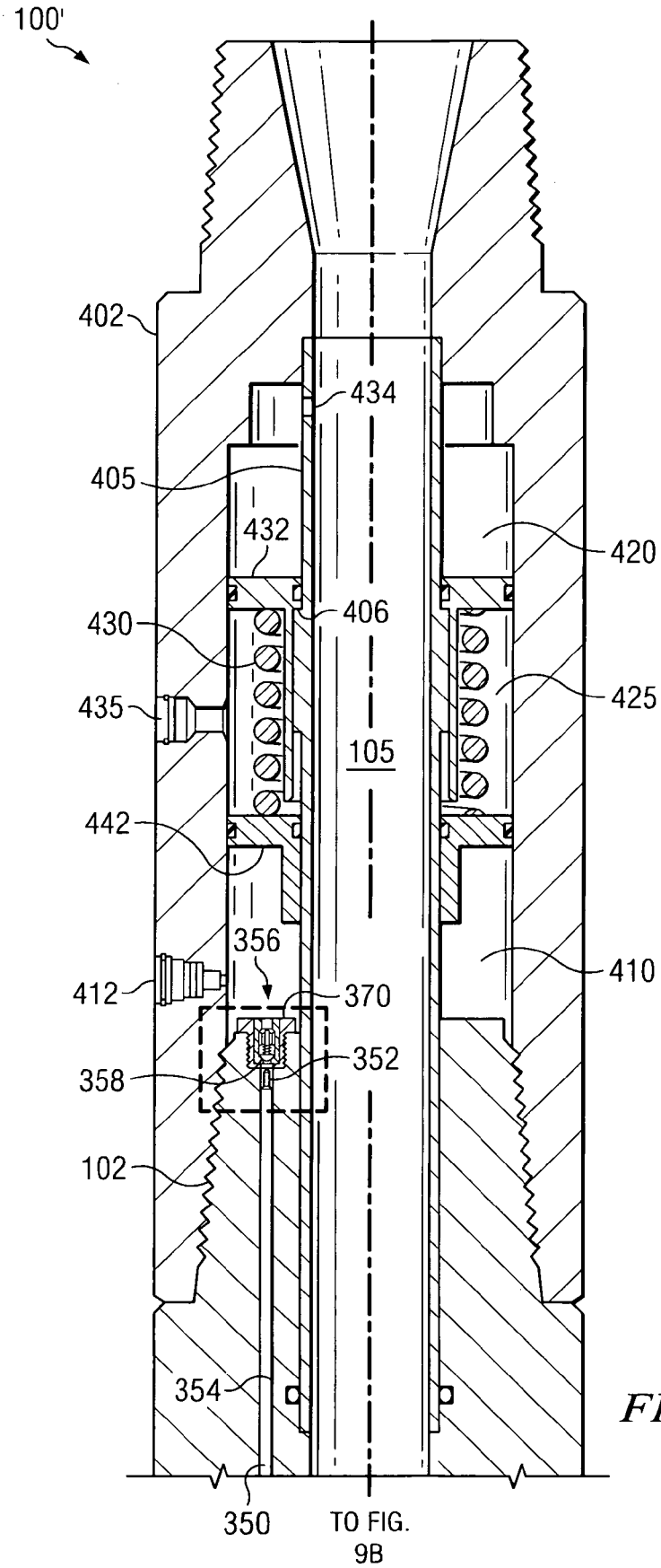
FIGS. 9A and 9B depict, in longitudinal cross section, the exemplary near-bit stabilizer embodiment shown on FIGS. 3A and 3B, connected with a hydraulic oil replenishing sub.
Figure 9B:
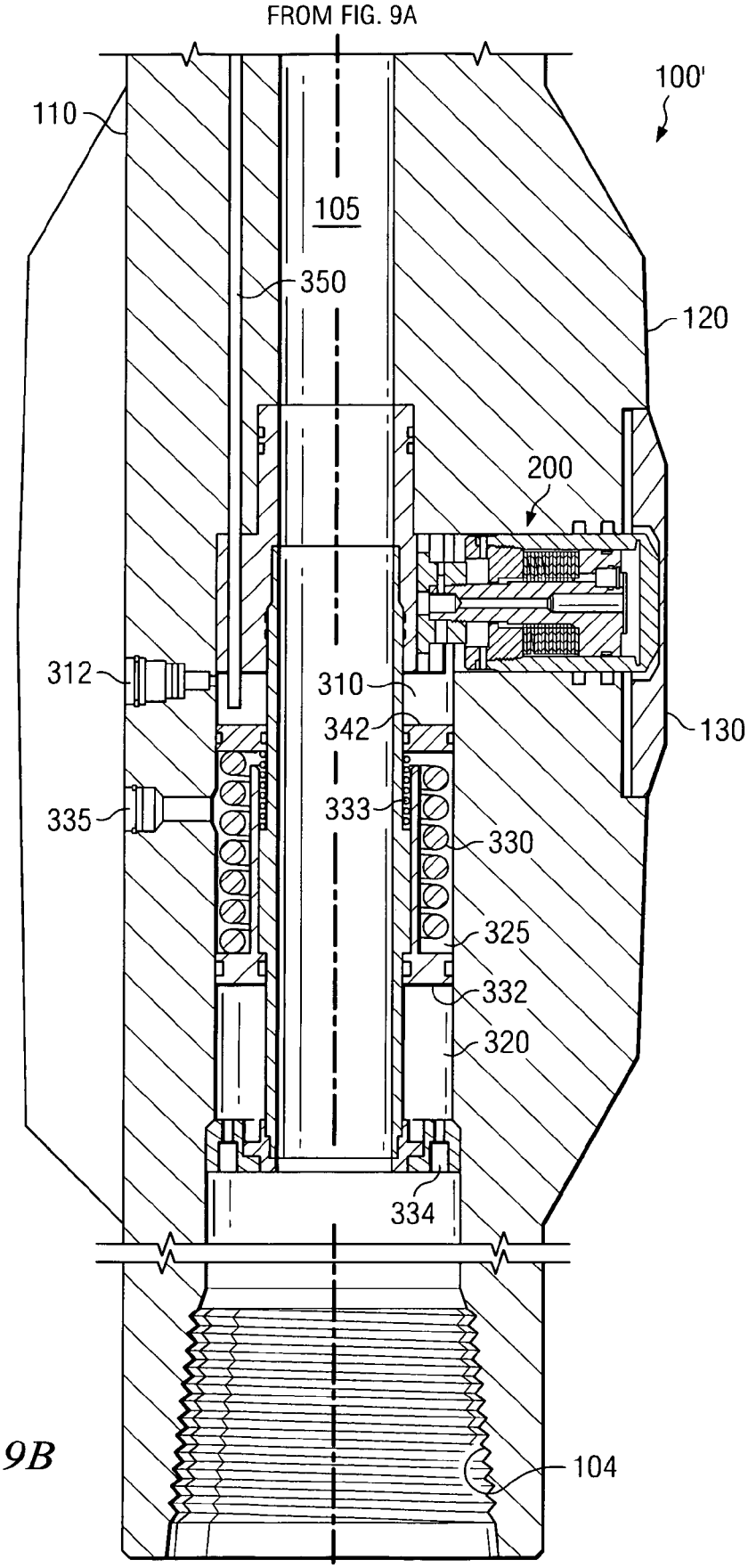

With reference now to FIGS. 9A and 9B, certain exemplary embodiments of hydraulic module 300 (FIG. 3A) may advantageously include or be connected to a hydraulic oil replenishing system 400 to maintain a sufficient quantity of hydraulic oil in module 300. An oil replenishing system tends to advantageously increase the run time of downhole tool 100' since oil can be lost through various seals during operation. One exemplary embodiment of a replenishing sub 400 in accordance with the invention is depicted in FIG. 9A. In the exemplary embodiment shown, replenishing sub 400 is a stand alone module that may be coupled to stabilizer 100' at pin end 102. Replenishing sub 400 is similar to hydraulic module 300 in that it is configured to convert highly variable drilling fluid pressure (mud pump pressure) in through bore 105 to a near constant pressure hydraulic fluid (which is made available to the hydraulic module 300 as described in more detail below). In the exemplary embodiment shown, replenishing sub 400 includes a substantially annular hydraulic fluid chamber 410 and first and second drilling fluid chambers 420 and 425. Chambers 410, 420, and 425 are located radially between an outer surface of sleeve 405 and an inner surface of sub housing 402. Chamber 410 is typically filled with hydraulic oil, for example, via port 412. Drilling fluid chamber 420 is in fluid communication with drilling fluid being pumped down through bore 105 (in the interior of the sub 400). Drilling fluid chamber 420 extends axially from a system positioning piston 432 (on a lower end) to a drilling fluid inlet port 434 (on an upper end). Drilling fluid chamber 425 is in fluid communication with drilling fluid exterior to the tool and extends axially from a system positioning piston 432 (on an upper end) to pressure piston 442 (on the lower end). System pressure piston 442 is deployed between hydraulic fluid chamber 410 and drilling fluid chamber 425.

In the exemplary embodiment shown, replenishing sub 400 further includes a system pressure spring 430 deployed in drilling fluid chamber 425. Spring 430 is located axially between system pressure piston 442 and a positioning piston 432. In the exemplary embodiment shown, positioning piston 432 is disposed to reciprocate axially between the drilling fluid inlet port 434 and an outer shoulder 406 of sleeve 405 (as shown on FIG. 9A). Prior to activating the replenishing system 400, system pressure spring 430 urges the positioning piston 432 into contact with the drilling fluid inlet port 434 where it may optionally be held in place via a shear pin arrangement analogous to that shown at 348 in FIG. 8A. Upon activation of the replenishing system, positioning piston 432 moves downwards into contact with shoulder 406 under the influence of drilling fluid pressure as drilling fluid chamber 420 is filled. Such movement of the positioning piston 432 compresses system pressurizing spring 430, which urges system pressure piston 442 downwards thereby pressuring the hydraulic oil in chamber 410. The exemplary embodiment of replenishing sub 400 shown further includes an exhaust port 435 through which drilling fluid may enter and exit drilling fluid chamber 425.

With continued reference to FIGS. 9A and 9B, the hydraulic module 300 of tool 100' is further configured to be used with (and connected to) the replenishing sub 400. A check (or relief) valve 356 is deployed in the pin end of tool 100' (e.g., in a valve housing 370) such that it permits fluid flow from system chamber 310 in hydraulic module 300 to hydraulic chamber 410 in sub 400. Reverse flow (from chamber 410 to chamber 310) is checked (blocked). An extension rod 350 extends from hydraulic chamber 310 to the check valve 356 through fluid channel 354 where it contacts (or nearly contacts) a sealing ball 358 (see FIG. 10A) in check valve 356. As the hydraulic fluid volume in chamber 310 is depleted (e.g., during a drilling operation), piston 342 moves upwards (owing to the bias of spring 330) towards extension rod 350. When sufficient fluid volume has been depleted from chamber 310, the movement of piston 342 urges extension rod 350 upwards, such that rod end 352 opens check valve 356 (by pushing sealing ball 358 off seat 359). The hydraulic oil in chamber 410 of sub 400 is typically held at a higher pressure than that of chamber 310 so that oil flows from the replenishing sub 400 through valve 356 and channel 354 to the hydraulic module 300 in tool 100' (i.e., from chamber 410 to 310). As chamber 310 refills, piston 342 moves back downwards away from rod 350, which allows the check valve 356 to close such that sealing ball 358 is biased into contact with seat 359 and fluid flow from chamber 410 to chamber 310 is checked.

As described above, check valve is disposed to permit fluid flow from chamber 310 to chamber 410 of the replenishing sub 400. Such flow is restricted during normal tool operations since the pressure in chamber 410 is greater than that in chamber 310. In the event that hydraulic chamber 310 is over filled during tool operation (for example owing to a leaking check valve), such excess fluid tends to flow back into chamber 410 of the replenishing sub 400 through check valve 356 when the hydraulic system is deactivated (e.g., when the mud pumps are turned off).

Figure 10A:
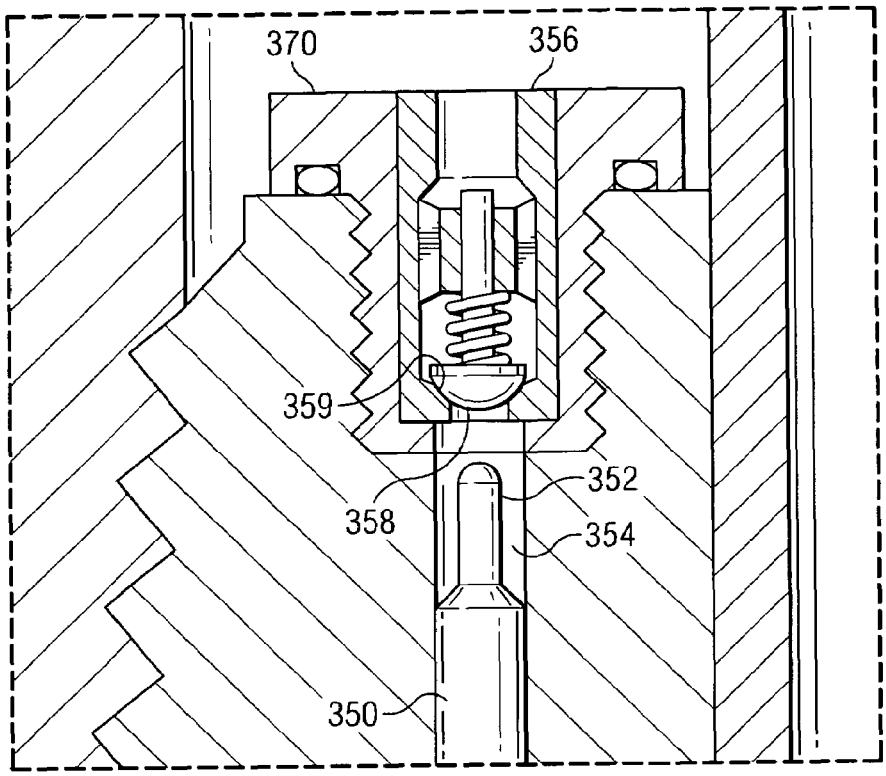
FIG. 10A depicts a detailed view of the check valve assembly 356 shown on FIG. 9.
Figure 10B:
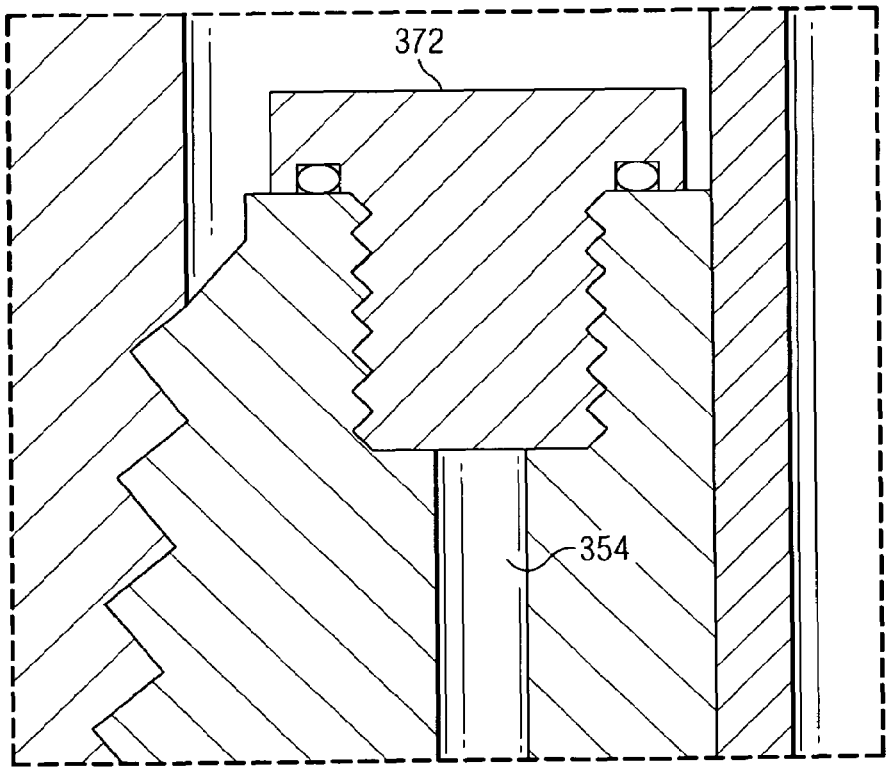
FIG. 10B depicts the same view as shown on FIG. 10A, with the exception that a seal plug 372 has replaced the check valve.

With brief reference now to FIG. 10B, it will be appreciated that the exemplary stabilizer embodiment 100' depicted on FIGS. 9A and 9B may be utilized with or without replenishing a sub 400. FIGS. 9A, 9B, and 10A depict use with the sub 400 (as described above). In the event that the sub 400 is not utilized, a seal plug 372 is deployed in the pin end 102 (replacing valve 356 and valve housing 370). Rod 350 is also removed from channel 354. In such instances, pin end 102 may be connected directly to other downhole tools, e.g., a steering tool (as shown on FIG. 1) or other BHA component.

Although the present invention and its advantages have been described in detail, it should be understood that various changes, substitutions and alternations can be made herein without departing from the spirit and scope of the invention as defined by the appended claims.

I claim:

1. A downhole tool comprising:

a substantially cylindrical drill collar having a through bore;

a first drilling fluid chamber connected with the through bore via an inlet port, the first drilling fluid chamber located between a positioning piston and the inlet port, the positioning piston disposed to reciprocate between first and second opposed positions, the positioning piston being disposed in the first position when a pressure in the drilling fluid in the through bore is greater than a predetermined threshold;

a hydraulic fluid chamber; and a system pressure spring deployed between the positioning piston and a system pressure piston, the system pressure piston in contact with the hydraulic fluid chamber, the system pressure spring disposed to pressurize hydraulic fluid in the hydraulic fluid chamber when the positioning piston is in the first position.

2. The downhole tool of claim 1, further comprising a second drilling fluid chamber, the second drilling fluid chamber in fluid communication with drilling fluid exterior to the tool, the positioning piston being deployed between the first and second drilling fluid chambers, and the system pressure spring being deployed in the second drilling fluid chamber.

3. The downhole tool of claim 2, wherein the first and second drilling fluid chambers and the hydraulic fluid chamber are substantially annular in shape and are housed between an external surface of a sleeve and an internal surface of the drill collar, the sleeve being deployed in the through bore.

4. The downhole tool of claim 3, wherein a relief groove is formed in an outer surface of the sleeve, the relief groove operative to allow excess fluid pressure in the hydraulic fluid chamber to vent from the hydraulic fluid chamber to the second drilling fluid chamber.

5. The downhole tool of claim 4, further comprising a secondary spring deployed between the system pressure piston and a shoulder on the sleeve, the secondary spring disposed to prevent the system pressure piston from translating into the relief groove when the positioning piston is in the second position.

6. The downhole tool of claim 2, further comprising an exhaust port disposed to provide fluid communication between the second drilling fluid chamber and the drilling fluid exterior to the tool.

7. The downhole tool of claim 2, wherein the first positioning piston position is adjacent a stop in the second tilling fluid chamber and the second positioning piston position is adjacent the inlet port.

8. The downhole tool of claim 1, further comprising at least one shear pin disposed to secure the positioning piston in the second position, the shear pin disposed to shear at a predetermined drilling fluid pressure in the through bore which allows the positioning piston to compress the system pressure spring and thereby pressurize the hydraulic fluid chamber.

9. The downhole tool of claim 1, wherein a pressure in the hydraulic fluid chamber is substantially constant and independent of drilling fluid pressure in the through bore when the drilling fluid pressure in the through bore is above the predetermined threshold.

10. The downhole tool of claim 1, further comprising at least one radially actuatable piston in fluid communication with the hydraulic fluid chamber, the radially actuatable piston being disposed to extend radially outward from the drill collar into contact with a borehole wall.

11. The downhole tool of claim 1, further comprising a hydraulic fluid replenishing chamber disposed to maintain a predetermined oil volume in the hydraulic fluid chamber.

12. The downhole tool of claim 11, wherein a pressure in the replenishing chamber is greater than a pressure in the hydraulic fluid chamber.

13. The downhole tool of claim 11, wherein the replenishing chamber is located in a replenishing sub that is threadably coupled with the downhole tool.

14. The downhole tool of claim 11, wherein the tool further comprises a hydraulic fluid channel disposed between the replenishing chamber and the hydraulic fluid chamber, the channel including a check valve and a push rod deployed therein, the check valve disposed to permit fluid flow from the hydraulic fluid chamber to the replenishing chamber, the push rod deployed between the system pressure piston and the cheek valve, the system pressure piston disposed to urge the push rod into contact with the check valve, thereby opening the cheek valve, when a fluid volume in the hydraulic fluid chamber is below a predetermined threshold, said opening of the check valve allowing hydraulic fluid to flow down a pressure gradient from the replenishing chamber to the hydraulic fluid chamber.

15. A downhole tool comprising:

a substantially cylindrical though bore;

a hydraulic module in fluid communication with a hydraulic replenishing system, the hydraulic replenishing system disposed to replenish hydraulic fluid in the hydraulic module; and a hydraulic fluid channel disposed between a hydraulic chamber in the replenishing system and a hydraulic chamber in the hydraulic module; the fluid channel including a check valve and a push rod deployed therein, the check valve disposed to permit fluid flow from the hydraulic module to the replenishing system, the push rod deployed between a piston in the hydraulic module and the check valve, the piston in the hydraulic module disposed to urge the push rod into contact with the check valve thereby opening the check valve when a fluid volume in the hydraulic module is below a predetermined threshold, said opening of the check valve allowing hydraulic fluid to flow down a pressure gradient from the replenishing system to the hydraulic module.

16. The downhole tool of claim 15, wherein the hydraulic module and the hydraulic replenishing system each comprise:

a first drilling fluid chamber in fluid communication with drilling fluid in the through bore, the drilling fluid chamber disposed between a positioning piston and a port connecting the first drilling fluid chamber to the through bore, the positioning piston disposed to reciprocate between first and second opposed positions, the positioning piston disposed in the first position when a pressure in the drilling fluid in the through bore is greater than a predetermined threshold;

a hydraulic fluid chamber; and a system pressure spring deployed between the positioning piston and a system pressure piston, the system pressure piston in contact with the hydraulic fluid chamber, the system pressure spring disposed to pressurize hydraulic fluid in the hydraulic fluid chamber when the positioning piston is in the first position.

17. The downhole tool of claim 16, wherein the hydraulic module and the hydraulic replenishing system each further comprise a second drilling fluid chamber, the second drilling fluid chamber in fluid communication with drilling fluid exterior to the tool, wherein:

the positioning piston is deployed between the first and second drilling fluid chambers, the first positioning piston position adjacent a stop in the second drilling fluid chamber and the second positioning piston position adjacent the port connecting the first drilling fluid chamber to the through bore; and and the system pressure spring is deployed in the second drilling fluid chamber.

18. The downhole tool of claim 16, wherein the push rod is deployed between the check valve and the system pressure piston in the hydraulic module.

19. The downhole tool of claim 15, wherein the hydraulic replenishing system is deployed in a distinct and separable sub.

20. A hydraulic module for use in a downhole tool, the hydraulic module disposed to provide substantially constant hydraulic pressure, the hydraulic module comprising:

first and second drilling fluid chambers, the first drilling fluid chamber in fluid communication with drilling fluid inside the tool, the second drilling fluid chamber in fluid communication with drilling fluid outside the tool;

a hydraulic fluid chamber;

a positioning piston deployed between the first and second drilling fluid chambers, the positioning piston disposed to displace between first and second longitudinally opposed positions, the first position adjacent a stop in the second drilling fluid chamber and the second position adjacent an inlet port disposed to permit drilling fluid in the through bore to enter the first drilling fluid chamber;

a system pressure piston deployed between the second drilling fluid chamber and the hydraulic fluid chamber; and a system pressure spring deployed in the second drilling fluid chamber, the system pressure spring being loaded between the positioning piston and the system pressure piston, the system pressure spring disposed to pressurize hydraulic fluid in the hydraulic fluid chamber when the positioning piston is in the first position.

21. The hydraulic module of claim 20, further comprising at least one shear pin disposed to secure the positioning piston in the second position, the shear pin disposed to shear at a predetermined drilling fluid pressure in the through bore which allows the system pressure piston to at least partially compress the system pressure spring and pressurize the hydraulic fluid chamber.

22. The hydraulic module of claim 20, wherein a pressure in the hydraulic fluid chamber is substantially constant and independent of drilling fluid pressure inside the tool when the drilling fluid pressure inside the tool is above a predetermined threshold.

23. The hydraulic module of claim 20, further comprising a hydraulic fluid replenishing chamber disposed to maintain a predetermined oil volume in the hydraulic fluid chamber.

24. The downhole tool of claim 23, wherein a hydraulic fluid channel disposed between the replenishing chamber and the hydraulic fluid chamber includes a check valve and a push rod deployed therein, the check valve disposed to permit fluid flow from the hydraulic fluid chamber to the replenishing chamber, the push rod deployed between the system pressure piston and the cheek valve, the system pressure piston disposed to urge the push rod into contact with the cheek valve, thereby opening the cheek valve, when a fluid volume in the hydraulic fluid chamber is below a predetermined threshold, said opening of the check valve allowing hydraulic fluid to flow down a pressure gradient from the replenishing chamber to the hydraulic fluid chamber.

25. The hydraulic control system of claim 20 being purely mechanical and not comprising any electronically or electrically controllable components.

* * * * *